United States Patent [19]

Anghelescu et al.

[11] Patent Number: 4,981,620

[45] Date of Patent: Jan. 1, 1991

[54] IN-LINE DEWAXING OF EDIBLE VEGETABLE OILS

[75] Inventors: Aurelia Anghelescu, Livingston; Leopold R. Strecker; George F. Winnie, both of Union, all of N.J.

[73] Assignee: CPC International Inc., Englewood Cliffs, N.J.

[21] Appl. No.: 635,762

[22] Filed: Jul. 30, 1984

[51] Int. Cl.[5] ..... C11B 3/04

[52] U.S. Cl. ..... 260/420; 260/428

[58] Field of Search ..... 260/420, 428, 707

[56] References Cited

U.S. PATENT DOCUMENTS

| | | | |
|---|---|---|---|
| 470,120 | 2/1923 | Strecker . | |
| 2,200,982 | 5/1940 | Dedlow | 260/428 |
| 2,625,482 | 1/1953 | Mattil et al. . | |
| 3,048,491 | 8/1962 | Gooding . | |
| 3,506,696 | 4/1970 | Baker et al. | 260/428 |
| 3,549,386 | 12/1970 | Menzies et al. | 260/428 |
| 3,673,228 | 6/1972 | Harris et al. | 260/428 |
| 3,895,042 | 7/1975 | Taylor | 260/428 |
| 3,943,155 | 3/1976 | Young | 260/424 |
| 3,955,004 | 5/1976 | Strauss et al. . | |
| 3,994,943 | 11/1976 | Gibble et al. . | |
| 4,035,402 | 7/1977 | Levine . | |
| 4,272,447 | 6/1981 | Deharry . | |
| 4,545,940 | 10/1985 | Muto et al. . | |

FOREIGN PATENT DOCUMENTS 1458800 12/1976 United Kingdom .

OTHER PUBLICATIONS

*Kirk-Othmer Encyclopedia of Chemical Technology*, 2nd Edition, vol. 6, 1965, pp. 486–487, pp. 9.E68.

D. Swern (editor), Bailey's Industrial Oil and Fat Products, pp. 1007–1011, 1034 (Third Ed.–Interscience Publishers).

F. E. Sullivan, Sunflower Oil Processing from Crude to Salad Oil, Jaocs, pp. 845(a)–847(a), (Nov. 1980).

G. Fuller, "Animal and Vegetable Oils, Fats and Waxes", Riegel's Handbook of Industrial Chemistry, pp. 344–357 (7th Ed. Van Nastrand Reinhold, 1974).

A. Foust, L. Wenzel, C. Clump, L. Mans, L. Anderson, Principles of Unit Operations, pp. 666–674 (Second Ed., John Wiley & Sons, Inc. 1980).

Kehse, W.: "Winterization of Sunflower Oil", Revue Francaise des Corps Gras, vol. 27, No. 12, Dec. 1980, pp. 567–570.

Bailey's Industrial Oil and Fat Products (ed. D. Swern) Interscience Publishers, N.Y. (3rd Ed.), 1964, pp. 256–259.

"Removal of Waxes from Sunflower Seed Oil by Miscella Refining and Winterization" by W. H. Morrison III and J. K. Thomas, Journal of the American Oil Chemists' Society, vol. 53, pp. 485–486, Jan. 1976.

"Winterization of Sunflower Oil" by Z. Leibovitz and C. Ruckenstein, Journal of the American Oil Chemists' Society, vol. 61, pp. 870–871, May 1984.

"New Processes in Degumming, Bleaching, Deacidification–Deodorization and Winterizing of Edible Oils" by Z. Leibovitz and C. Ruckenstein, Revue francaise des Corps Gras, vol. 28, pp. 303–308, Jul./Aug. 1981.

"Refining of Rice Bran Oil" by K. G. Ramaswamy et al., Chemical Abstracts, vol. 97, p. 512, Aug. 1982.

*Primary Examiner*—Charles F. Warren

[57] ABSTRACT

A method for the combined in-line bleaching and dewaxing of vegetable oils which includes the steps of bleaching the vegetable oil with a sufficient amount of bleaching clay and filter aid at a temperature of about 80°–130° C. for about 15–60 minutes, followed by rapid cooling of the bleached vegetable oil containing the bleaching clay, to a temperature of about 0°–15° C. for about 15 minutes–4 hours to thereby dewax the vegetable oil. The spent bleaching clay, waxy material and other impurities in the vegetable oil are then seaparted at low temperatures of about 0°–20° C., by such means as filtration, to thereby recover the bleached and dewaxed vegetable oil.

13 Claims, No Drawings

IN-LINE DEWAXING OF EDIBLE VEGETABLE OILS

BACKGROUND OF THE INVENTION

This invention relates to an in-line combined bleaching and dewaxing process for treating edible vegetable oils to produce a vegetable oil that has acceptable storage characteristics.

Crude vegetable oils are extracted from plant tissue and include such varieties as corn, milo, rapeseed (canola), ricebran, sunflower and safflower.

Crude vegetable oils contain undesirable minor components or impurities such as pigments, free fatty acids, phospholipids and oxidation products, which can cause undesirable color and/or "off flavors" in the finished vegetable oil. In addition, certain higher melting components must be removed from the vegetable oils if they are to be used in food products such as salad oils and dressings which must be refrigerated. Unless removed, the higher melting constituents would crystallize and separate when the vegetable oils are stored at refrigeration temperatures.

The conversion of crude vegetable oils into an acceptable product may require several treatment steps including degumming, alkali refining, bleaching, winterization, dewaxing and deodorization.

The term "winterization" is applied to a process for removing high melting material from oils whereby the oils are carefully cooled to low temperatures for extended periods of time to permit precipitation of solid material. Solid material can then be removed by filtration or other separation procedures. Examples of winterization processes are disclosed in U.S. Pat. Nos. 2,200,982 to Dedlow, 3,048,491 to Gooding and 4,035,402 to Levine.

Alkali refining of a vegetable oil involves its treatment with an alkali, such as sodium hydroxide, to remove free fatty acids, phospholipids, trace metals, pigments and oxidation products. The alkali solution neutralizes the free fatty acids contained in the crude vegetable oil, producing a soap stock which can be continuously removed by centrifugation. Phospholipids, also referred to as phosphatides, are soluble in the anhydrous vegetable oil, but after treatment with an alkali solution precipitate out with the soap stock and can also be removed.

Other alkali solutions, such as sodium bicarbonate, calcium hydroxide, potassium hydroxide, magnesium hydroxide, ammonia, and some organic bases can also be used in alkali refining a crude vegetable oil. Examples of alkali refining treatments are disclosesd in U.S. Pat. No. 3,943,155 to Young.

An alternative to "chemical" alkali refining, is physical refining whereby oil impurities are removed by physical means in the degumming, bleaching, dewaxing and steam refining/deodorization steps. During degumming, crude vegetable oil is mixed with a small amount of water (1–3%), agitated to achieve hydration of gums, primarily phospholipiods, thus making them insoluble in the vegetable oil, and further the hydrated gums are separated from the oil by such means as centrifugation. When the degumming is done at ambient or lower temperatures, a partial removal of waxes can also be achieved.

Alkali refining and degumming are alternative approaches that are generally used as preliminary steps in the purification of crude vegetable oils. Either alkali refining or degumming is generally used in combination with subsequent bleaching, dewaxing and deodorization treatments of the vegetable oil.

The purpose of bleaching step is to further purify the vetgetable oil by removing residual phospholipids, trace metal complexes and pigments such as carotene, chlorophyll and related compounds, as well as oxidation products. Moreover, where the bleaching step is preceded by alkali refining, the bleaching treatment can also remove residual soaps left by the alkali refining treatment.

In a conventional bleaching process, the vegetable oil is mixed with a bleaching clay which serves as an adsorbent. The bleaching clay-vegetable oil mixture is then heated for a period of time, and filtered to separate the spent adsorbent from the decolorized oil. Ordinarily, much of the bleaching action occurs during the holding of the oil/clay mixture at elevated temperatures under vacuum with intense agitation.

In the situation where degumming is used prior to the bleaching step, the bleaching is generally conducted in the presence of phosphoric acid which reacts with residual phospholipids, as well as with the metals present in the vegetable oil converting the metals into phosphates.

Activated carbon can also be used in place of the bleaching clay as an an adsorbent, however, for economic reasons, if it is used at all, it is generally mixed with the bleaching clay.

The bleaching step can be conducted under atmospheric pressure, however, it is usually done under vacuum conditions to avoid oxidizing the bleached oil. Examples of bleaching treatments are disclosed in U.S. Pat. Nos. 3,673,228 to Harris, 3,943,155 to Young and 3,955,004 to Strauss et al.

The bleached vegetable oil still contains small amounts of high melting point components, such as saturated glycerides, wax esters, sterol esters and hydrocarbons which can crystallize and precipitate at ambient temperatures, and especially at refrigeration temperatures. It is these high melting point compounds, generally referred to as waxes, which are responsible for the haze and cloudiness of an oil.

The conventional dewaxing process includes slow chilling of the oil to temperatures sufficient to crystallize the waxy components from the crude oil, preferably under gentle agitation. The crystallized components are then generally removed by a cold filtration step. U.S. Pat. Nos. 3,943,115 to Young, 3,994,943 to Gibble and 4,035,402 to Levine disclose various processes for dewaxing vegetable oils. U.S. Pat. No. 2,625,482 to Mattil discloses a dewaxing process for lard.

Following the bleaching and dewaxing steps, the oil may be deodorized, usually with steam under vacuum at a high temperature. Steam deodorization involves the contacting of steam with free fatty acids and other volatile odorous and off-flavor materials often present in the vegetable oil which are responsible for the undesirable odor and taste of non-deodorized oil. U.S. Pat. No. 3,506,969 to Baker et al discloses a typical steam deodorization process.

SUMMARY OF THE INVENTION

The present invention comprises a combined in-line bleaching and dewaxing process for vegetable oils which eliminates the filtration step that generally follows a bleaching operation, wherein spent bleach clay cake is removed. In essence, the present invention provides a process for refining crude vegetable oils by first degumming the oil, or alternatively subjecting it to an alkali refining treatment, then bleaching, cooling and holding the oil at a low temperature under agitation, followed by cold separation of the spent bleach clay cake, impurities and high melting point components.

DESCRIPTION OF THE PREFERRED EMBODIMENTS

In accordance with the present invention, a crude vegetable oil is initially subjected to cold degumming, or alternatively, an alkali refining treatment. The vegetable oil is then bleached in the presence of a bleaching clay and filter aid under vacuum and agitation, followed by cooling to a low temperature under agitation and maintaining the oil at the cooling temperature for a time sufficient to crystallize waxy impurities. The bleaching clay, which is retained throughout the process until final separation, serves as an adsorbent for oil impurities during the bleaching step, and as a seeding agent to induce crystallization of waxes during the dewaxing step. The spent bleach clay cake and crystallized impurities are then separated from the vegetable oil by cold filtration. The bleached and dewaxed vegetable oil can also be steam refined and deodorized in a conventional manner.

The present invention is applicable to a variety of vegetable oils including corn, milo, rapeseed (canola), ricebran, sunflower and safflower.

Although alkali refining of the crude vegetable oil can be performed as a preliminary purification step, the alternative cold degumming treatment is preferred because the cold degumming treatment advantageously removes a portion of the waxes. The degumming treatment involves cooling the crude vegetable oil to temperatures, of about 0° to 20° C., preferably 10° C., and mixing with a sufficient amount of cold water under agitation to achieve proper hydration of gums present in the vegetable oil and render them insoluble. For corn oil, it has been found that about 3% cold water by weight, agitated at about 10° C. for 30 minutes is sufficient to achieve proper hydration of the gums and render the gums insoluble in the oil. The oil can then be separated from the solids by centrifugation, followed by drying to reduce its moisture level to a suitable value, preferably less than about 0.1%.

Bleaching of the degummed vegetable oil is generally carried out at temperatures of 80° to 130° C., preferably 100° to 110° C. for about 15 to 60 minutes, preferably about 30 minutes, under vacuum and agitation.

The amount of bleaching clay will vary depending upon the particular vegetable oil being bleached, generally from about 0.5 to 5% by weight of the vegetable oil. A wide variety of bleaching clays are available, for example, Filtrol TM (Filtrol-Harshaw Chemicals, Inc.) and Vega Plus TM (Filtrol-Canada, Inc.).

A filter aid is also used in the bleaching step to assist the subsequent filtration of impurities following the dewaxing step. The amount of filter aid to bleaching clay can vary from about 5 to 50 parts by weight per 100 parts by weight of bleaching clay, preferably 1 part of filter aid to 3 parts of bleaching clay. Suitable filter aids include Hyflo Super Cel TM (Johns Manville, Inc.), Filter Cel TM (Johns Manville, Inc.) and Celatom TM (Eagle Picher, Inc.).

The bleaching step is also conducted in the presence of phosphoric acid to remove residual phospholipids, where the crude vegetable oil has been cold degummed prior to bleaching. The phosphoric acid can be of varying concentration, preferably about 75 to 85%, and generally can vary in amount of from about 0.04 to about 0.12% by weight of the crude vegetable oil.

Following the bleaching step, the bleached vegetable oil-bleaching clay mixture is then cooled to a temperature of about 0° to 15° C., preferably about 5° to 10° C. and maintained at this temperature for about 15 minutes to 4 hours accompanied by sufficient agitation.

After the vegetable oil is cooled for a sufficient time under agitation, it is then separated from the spent bleaching clay, usually by filtration at low temperature. Cold filtration can be conducted at temperatures of about 0° to 20° C., preferably about 10° to 15° C.

The temperature maintained during the filtration step is generally the same as that maintained during the dewaxing step. However, during filtration the temperature may increase by 1–5 degrees C. above the dewaxing temperature due to warm-up in the processing equipment.

The examples which follow demonstrate the efficacy of the present invention. The vegetable oils produced in the following examples were evaluated for wax removal on the basis of visual inspection of the samples under different temperature storage conditions of room temperature, referigeration, and ice-water bath. In addition, instrumental turbidity measurements were made using a Hach Ratio Turbidimeter. All parts and percentages are by weight, based on the vegetable oil, unless otherwise noted.

EXAMPLE 1

Seven 1500 gram samples of degummed and dried corn oil, containing 20 ppm phosphorus were pretreated with 0.083% $H_3PO_4$ at 45° C., 50 mm Hg absolute pressure for 10 minutes and then bleached with 2.5% Filtrol 105 bleaching clay and 0.5% Hyflo Super Cel filtering aid at 105° C. and 50 mm Hg absolute pressure for 20 minutes. The mixtures were rapidly cooled at an average temperature gradient of 15° C. per minute to temperatures of 5° C., and 15° C. The cold slurry which formed was filtered on an open jacketed porcelain laboratory vacuum filter through two sheets of 12.5 cm diameter Whatman 41 filter paper. During filtration, cold brine was circulated through the jacketed filter. The filtered oil was dried at 45° C., 0.1 mm Hg absolute pressure for 10 minutes to remove any moisture resulting from condensation and then filtered again through 2 micron Millipore tilter pads. Each sample was then visually evaluated during cold tests at 0° C. at intervals of 24, 72 and 120 hours. Clarity after 24 hours was a minimum requirement to pass the cold test. Refrigeration tests were also conducted at 7° C. at intervals of 1, 3 and 5 days. For the refrigeration test, clarity at 3 days was a minimum requirement. The samples were also instrumentally evaluated for turbidity using a Hach Ratio Turbidimeter. A maximum turbidity increase of 0.30 NTU at 24 hours was necessary to pass the turbidity evaluation. The results of these tests are tabulated in Table 1 which follows.

TABLE 1

Effect of In-Line Dewaxing Parameters on Clarity of Bleached Corn Oil

| Sample # | Dewaxing Temp. °C. | Holding Time at Dewax. Temp. Hrs. | Cold Test Hours at 0° C. 24 | 72 | 120 | Refrigeration Test Days at 7° C. 1 | 3 | 5 | Turbidity Increase ΔNTU at 0° C. 24 Hrs. | 96 Hrs. |
|---|---|---|---|---|---|---|---|---|---|---|
| 1 | 15 | 0 | Cloudy | Cloudy | Cloudy | Hazy | Cloudy | Gel | 0.95 | 0.85 |
| 2 | 15 | 2 | Clear | Cloudy | Cloudy | Clear | Clear | Cloudy | 0.16 | 0.93 |
| 3 | 10 | 1 | Clear | Hazy | Cloudy | Clear | Clear | Gel | 0.16 | 0.33 |
| 4 | 10 | 1 | Clear | Hazy | Cloudy | Clear | Clear | Crystals | 0.14 | 0.25 |
| 5 | 5 | 0 | Clear | Hazy | Cloudy | Sl. Hazy | Cloudy | Cloudy | 0.20 | 0.51 |
| 6 | 5 | 2 | Clear | Sl. Hazy | Cloudy | Clear | Clear | Crystals | 0.15 | 0.18 |
| 7 | 5 | 4 | Clear | Sl. Hazy | Hazy | Clear | Clear | Clear | 0.20 | 0.24 |

EXAMPLE 2

Four 140 pound batches of degummed corn oil having 20 ppm phosphorus were bleached with 0.083% $H_3PO_4$, 2.5% Filtrol 105 bleaching clay and various amounts of Filter Cel filtering aid varying from 0 to 0.25% by weight. In order to assess the effect of phosphorus level on filtration rate, the degummed oil in batch 2 was spiked with 5% crude corn oil. Half of each batch was filtered hot at approximately 176° F. (80° ).) and constant pressure through a 1.26 square foot (0.117 square meter) Sparkler filter. The remaining half of each batch was cooled with agitation to 45°-50° F. (8°-10° C.) in 40-45 minutes. The oil was then held at 50° F. (10° C.) for one hour before filtering through the same clean filter. A portion of oil from each hot filtration batch was used in a conventional dewaxing operation, which was designated as batch number 5 in the tabulated data which follows this example. The oil contained 0.75% filtering aid and no bleaching agent. Each oil was then subjected to a cold test at 0° C., a refrigeration test at 7° C., a room temperature test at 25° C., and a turbidimeter test. The standards for each of these tests are the same as those specified in Example 1, with the additional requirement that the samples be clear in order to pass the room temperature test. The data obtained is tabulated in Table 2, which follows:

TABLE 2

| Batch Samples | Dewaxing | Filtration Temperature °C. | Cold Test Hrs. at 0° C. 3.5 | 24 | 48 | 144 | Turbidity Increase ΔNTU Hrs. at 0° C. 1 | 2 | 24 | 44 |
|---|---|---|---|---|---|---|---|---|---|---|
| *1A | No | 83-89 | Hazy | Hazy | Crystals | Crystals | 0.76 | 1.09 | 1.40 | 1.49 |
| 1B | Yes | 10-13 | Clear | Clear | Clear | Clear | 0.26 | 0.22 | 0.22 | 0.23 |
| **2A | No | 89-92 | Hazy | Hazy | Hazy | Cloudy | 0.98 | 1.37 | 1.73 | 1.83 |
| 2B | Yes | 10-11 | Clear | Clear | Clear | Clear | 0.29 | 0.29 | 0.30 | 0.32 |
| ***3A | No | 87-90 | Hazy | Hazy | Crystals | Gel | 0.79 | 1.10 | 1.43 | 1.53 |
| 3B | Yes | 10-13 | Clear | Clear | — | — | 0.17 | 0.17 | 0.18 | 0.19 |
| ****4A | No | 86-91 | Hazy | Hazy | Crystals | Gel | 0.71 | 1.02 | 1.33 | 1.40 |
| 4B | Yes | 10-11 | Clear | Clear | Clear | Clear | 0.23 | 0.24 | 0.23 | 0.28 |
| 5 | Yes | 8-9 | Clear | Clear | Clear | Crystals | 0.20 | 0.19 | 0.21 | 0.23 |

| Batch Samples | Refrigeration Test Days at 7° C. 1 | 2 | 13 | Room Temperature Test Days at 25° C. 2 | 3 | 14 |
|---|---|---|---|---|---|---|
| 1A | Hazy | Cloudy | Gel | Clear | Clear | Crystals |
| 1B | Clear | Clear | Cloudy | Clear | Clear | Clear |
| 2A | Hazy | Hazy | Cloudy | Clear | Clear | Crystals |
| 2B | Clear | Clear | Clear | Clear | Clear | Clear |
| 3A | Hazy | Hazy | Cloudy | Clear | Clear | Crystals |
| 3B | Clear | Clear | Cloudy | Clear | Clear | Clear |
| 4A | Hazy | Hazy | Cloudy | Clear | Clear | Crystals |
| 4B | Clear | Clear | Crystals | Clear | Clear | Clear |
| 5 | Clear | Clear | Crystals | Clear | Clear | Clear |

*Batch 1 contained 2.5% bleaching clay and 0.5% filter aid.
**Batch 2 contained 5% crude corn oil, 2.5% bleaching clay and 0.5% filter aid.
***Batch 3 contained 2.5% bleaching clay and 0% filter aid.
****Batch 4 contained 2.5% bleaching clay and 0.25% filter aid.

EXAMPLE 3

A crude corn oil was degummed by cooling it to 10° C., mixing it with 3% cold water, and agitating the mixture at 10° C. for 30 minutes to achieve proper hydration of the gums and render them insoluble in the oil. The gums were then separated from the oil by centrifugation. The oil was dried in a falling film vacuum drier to reduce its moisture level to less than 0.1%, and was then divided into two samples.

The first sample was placed in a 3 liter flask equipped with heating, agitation and vacuum, and reacted with 0.1% phosphoric acid (85% concentration) at 40° C. for 15 minutes with continuous stirring. 2.5% activated bleaching clay (Vega Plus TM) and 0.5% filter aid (Celatom TM) were added to the oil and the mass was heated to 100° C. under vacuum of 50 mm Hg absolute pressure with intense stirring. The mixing at this temperature continued for 20 minutes. Afterwards, the vacuum was broken by sparging nitrogen into the flask and the oil was filtered through Whatman #41 filter paper in a Buechner funnel.

The second sample of degummed oil was subjected to the same pretreatment with phosphoric acid and bleaching clay as the first sample. However, after heating at 100° C. for 20 minutes, the mass was cooled to 10° C. in a water/ice bath and held at this temperature with agitation for 1 hour. The oil was then filtered in a chilled Buechner funnel through Whatman #41 filter paper. The bleached/dewaxed oil obtained was designated Sample 2. The clarity of both samples was compared during storage at 0° C., 7° C., and 25° C. The results of this comparison are tabulated in Table 3 which follows.

TABLE 3

COMPARISON OF NON-DEWAXED AND IN-LINE DEWAXED CORN OILS

| SAMPLE CODE | Sample 1 NON-DEWAXED | Sample 2 DEWAXED |
|---|---|---|
| Cold Test Hrs. at 0° C. | | |
| 18 | hazy | clear |
| 28 | hazy | clear |
| 48 | hazy/turbid | clear |
| 92 | flocculent material | clear |
| Refrigeration Test Days at 7° C. | | |
| 1 | hazy | clear |
| 2 | turbid | clear |
| 4 | turbid | clear |
| Room Temperature Storage Days at 25° C. | | |
| 1 | crystals | clear |
| 2 | crystals | clear |
| 4 | turbid | clear |

EXAMPLE 4

A crude corn oil was degummed, dried and cooled to 40° C. in a conventional manner. The degummed oil was then reacted with 0.08% phosphoric acid (85% concentration) under intense agitation for 20 minutes. The pretreated oil was then pumped to a slurry tank and blended with 2.4% activated bleaching clay (Filtrol 105 TM) and 0.8% filter aid (Celatom TM). The oil/clay mixture was then preheated to 105° C. in a series of heat exchangers and then pumped to a vacuum bleacher operating under 50 mm Hg absolute pressure. After 30 minutes residence time in the bleacher, the mass was passed through several heat exchangers reducing its temperature at a rate of 10°-20° C. per minute, to 7°-9° C., then pumped to a crystal growth tank, where it was agitated for 1.5-1.7 hours residence time to crystallize waxy oil components. The cold mass of oil was continuously withdrawn from the bottom of the crystal growth tank and filtered in a pressure leaf type filter to separate a clear oil from the solids, which consisted of spent bleaching clay, filter aid and high melting point oil components. Six samples of the oil were tested, based upon different dewaxing temperatures. A control sample was also prepared by conventional dewaxing procedure involving bleaching corn oil by the same treatment as described above, filtering the bleached oil at 80° C. to separate spent bleaching clay and filter aid, followed by cooling the clear bleached oil to 15° C., mixing the chilled oil with 0.75% filter aid, to act as a seeding agent for crystallization of waxes, holding the mixture for 4 hours in an agitated tank to achieve crystallization of waxes and other high melting oil components, followed by filtration in a plate and frame filterpress for separating clear oil from the solids. Clarity of each of the samples including the control sample designated as Sample 7 are tabulated in Table 4 which follows.

TABLE 4

| | | PLANT IN-LINE DEWAXING OF CORN OIL | | | | | | | | |
|---|---|---|---|---|---|---|---|---|---|---|
| | DEWAXING TEMP. | HOLDING TIME @ DEWAXING TEMP. | COLD TEST HRS. AT 0° C. | | | | TURBIDITY INCREASE ΔNTU; HRS. AT 0° C. | | | |
| Sample | °C. | HRS. | 14 | 24 | 39 | 63 | 14 | 24 | 39 | 63 |
| 1 | 9 | 1.5 | Clear | Clear | Hazy | Hazy | 0.14 | 0.23 | 0.42 | 0.47 |
| 2 | 8.5 | 1.7 | Clear | Clear | Clear | Clear | 0.13 | 0.13 | 0.13 | 0.13 |
| 3 | 7 | 1.6 | Clear | Clear | Clear | Clear | 0.07 | 0.06 | 0.09 | 0.09 |
| 4 | 7 | 1.8 | Clear | Clear | Clear | Clear | 0.07 | 0.06 | 0.08 | 0.07 |
| 5 | 7.8 | 1.5 | Clear | — | Clear | — | 0.07 | — | 0.09 | — |
| 6 | 7.6 | 1.6 | Clear | — | Clear | — | 0.08 | — | 0.10 | — |
| 7 | 15 | 2 | Sl. Hazy | Hazy | Hazy | Hazy | 0.30 | 0.41 | 0.47 | 0.51 |

EXAMPLE 5

A degummed rapeseed (canola) oil with a residual phosphorus content of less than 30 ppm was bleached and in-line dewaxed according to the procedure described in Example 4. The specific parameters employed were:

| | |
|---|---|
| Pretreatment | |
| Oil flow rate | 68 l/min. |
| $H_3PO_4$ | 0.09% |
| Oil temperature | 25° C. |
| Reaction time | 20 min. |
| Bleaching | |
| Amount of bleaching clay, Filtrol 105 TM | 2.7% |
| Amount of filteraid, Celatom TM | 0.9% |
| Temperature | 110-118° C. |
| Time | 30 min. |
| Vacuum | 50 mm Hg abs. pres. |
| In-Line Dewaxing | |
| Temperature in crystal growth tank | 7-8° C. |
| Retention time | 1.5 hours |
| Filtration temperature | 10-11° C. |

In a separate production run, the degummed rapeseed oil was subjected to a similar bleaching treatment as described above, however, it was hot filtered at 80° C., and the in-line dewaxing step was omitted. Both samples were then compared for clarity on the basis of a cold test at 0° C. and turbidity measurement. This data is tabulated in Table 5 which follows.

TABLE 5

COMPARISON OF IN-LINE DEWAXED AND NON-DEWAXED RAPESEED OIL

| SAMPLE DESCRIPTION | COLD TEST Hrs. at 0° C. | | | | TURBIDITY INCREASE, ΔNTU Hrs. at 0° C. | | |
|---|---|---|---|---|---|---|---|
| | 1 | 2 | 24 | 48 | 1 | 3 | 4 |
| In-line dewaxed | clear | clear | clear | clear | 0.00 | 0.08 | 0.024 |
| Non-dewaxed | hazy | hazy | — | — | 1.64 | 2.04 | 2.04 |

We claim:

1. A method for combined in-line bleaching and dewaxing of vegetable oils comprising:

(a) degumming the vegetable oil by cooling at a temperature of 0°-20° C. and mixing said oil with a sufficient amount of cold water under agitation to hydrate gums present in said vegetable oil, thereby rendering them insoluble;

(b) separating said oil from the hydrated gums present in the oil by centrifuging and drying said oil, thereby reducing the oil's moisture level to a value preferably less than about 0.1%;

(c) bleaching said oil with a sufficient amount of bleaching clay and filter aid in the presence of phosphoric acid, at a concentration of about 75-85% and in an amount of 0.04 to about 0.12% by weight of said oil, under vacuum and agitation at a temperature of about 100°-110° C. for about 30 minutes;

(d) rapidly cooling the bleached oil containing the bleaching clay under agitation at an average temperature gradient of about 10°-20° C. per minute, to a temperature of about 0°-15° C., holding at this temperature for about 15 minutes to 4 hours, thereby dewaxing said oil;

(e) separating the spent bleaching clay, waxy material and other impurities from said oil by filtration at a temperature of about 0°-20° C.; and (f) recovering the bleached and dewaxed vegetable oil.

2. A method for combined in-line bleaching and dewaxing of vegetable oils comprising:

(a) degumming the vegetable oil by cooling to a temperature of 10°-20° C. and mixing said oil with 3% cold water under agitation to hydrate gums present in said vegetable oil, thereby rendering them insoluble;

(b) separating said oil from the hydrated gums present in the oil by centrifuging and drying said oil, thereby reducing the oil's moisture level to less than about 0.1%;

(c) bleaching said oil with a sufficient amount of bleaching clay and filter aid in the presence of 0.08 to 0.10% of phosphoric acid by weight of said oil, in a concentration of 85%, under vacuum and agitation at a temperature of about 100°-105° C. for about 20-30 minutes;

(d) rapidly cooling the bleached oil containing the bleaching clay under agitation at an average temperature gradient of about 10°-20° C. per minute to a temperature of about 7°-10° C., holding at this temperature for about 1-2 hours, thereby dewaxing said oil;

(e) separating the spent bleaching clay, waxy material and other impurities from said oil by filtration at a temperature of about 10°-15° C.; and (f) recovering the bleached and dewaxed vegetable oil.

3. A method for combined in-line bleaching and dewaxing of corn oil consisting of:

(a) degumming the corn oil by cooling to a temperature of about 10° C. and mixing said oil with about 3% cold water under agitation for about 30 minutes to hydrate gums present in said corn oil, thereby rendering them insoluble;

(b) separating said oil from the hydrated gums present in the oil by centrifuging and drying said oil, thereby reducing the oil's moisture level to less than about 0.1%;

(c) bleaching said oil with a sufficient amount of bleaching clay and filter aid in the presence of about 0.08-0.10% of phosphoric acid by weight of said oil, in a concentration of about 85%, under vacuum and agitation at a temperature of about 100-105° C. for about 20 minutes;

(d) rapidly cooling the bleached oil containing the bleaching clay under agitation at an average temperature gradient of about 15° C. per minute to a temperature of about 10° C., holding at this temperature for about 1 hour, thereby dewaxing said oil;

(e) separating the spent bleaching clay, waxy material and other impurities from said oil by filtration at a temperature of about 10°-15° C.; and (f) recovering the bleached and dewaxed corn oil.

4. The method of claim 1, wherein said vegetable oils are selected from the group consisting of corn, milo, rapeseed (canola), ricebran, sunflower, and safflower.

5. The method of claim 1, wherein the vegetable oil is subjected to alkali refining prior to the bleaching step.

6. The method of claim 5, wherein the vegetable oil, after the alkali refining treatment, is dried to a moisture level of less than about 0.1 wgt %.

7. The method of claim 1, wherein the bleaching clay varies from about 0.5-5% by weight of the vegetable oil.

8. The method of claim 1, wherein the filter aid varies from about 5-50 parts by weight per 100 parts by weight of the bleaching clay.

9. The method of claim 8, wherein the proportion of filter aid to bleaching clay is about 1:3, respectively.

10. The method of claim 1, wherein said bleaching step is conducted under vacuum and agitation for about 15-60 minutes.

11. The method of claim 1, wherein the bleached oil is cooled at an average temperature gradient of about 15° C. per minute.

12. The method of claim 1 wherein said bleaching clay is used as a seeding agent for the crystallization of waxes.

13. The method of claim 1 wherein said filter aid is used for the simultaneous removal of the spent bleaching clay and waxy material.

* * * * *